US012303005B2

(12) United States Patent
Wu

(10) Patent No.: US 12,303,005 B2
(45) Date of Patent: May 20, 2025

(54) STORAGE BAG DEVICE CONVENIENT FOR QUICK SEARCH AND TAKING OUT

(71) Applicant: Yuantiao Wu, Shenzhen (CN)

(72) Inventor: Yuantiao Wu, Shenzhen (CN)

( * ) Notice: Subject to any disclaimer, the term of this patent is extended or adjusted under 35 U.S.C. 154(b) by 55 days.

(21) Appl. No.: 18/329,551

(22) Filed: Jun. 5, 2023

(65) Prior Publication Data

US 2024/0374003 A1 Nov. 14, 2024

(30) Foreign Application Priority Data

May 8, 2023 (CN) ..... 202310512774.1

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/149
See application file for complete search history.

(56) References Cited

U.S. PATENT DOCUMENTS 10,278,466 B2 * 5/2019 Talarico ..... A45C 11/182
10,667,588 B2 * 6/2020 Chan ..... A45C 11/18
2018/0368547 A1 * 12/2018 Grannan ..... A45C 11/182

FOREIGN PATENT DOCUMENTS

TW 201217188 A * 5/2012 ..... A45C 11/182

* cited by examiner

*Primary Examiner* — Sue A Weaver
(74) *Attorney, Agent, or Firm* — Hemisphere Law, PLLC; Zhigang Ma

(57) ABSTRACT

A storage bag device includes a base, the base is provided with at least one card tray and a controlling card ejection assembly, a rotating circlip member includes a circlip member, the circlip member is provided with a protruding piece and a torsional spring, the torsional spring is provided with a cylinder, a bottom of the cylinder is connected to the base, an end of the card tray is disposed in the circlip member, a switch member includes a slot, the slot is provided with a supporting seat including a first supporting part and a second supporting part, a spring is disposed on the first supporting part, the spring is provided with a button transmission rod therein, a switch resilient sheet is disposed on the second supporting part and includes an extending part, which extends to an outside of the slot and corresponds to the position of the protruding piece.

11 Claims, 10 Drawing Sheets

STORAGE BAG DEVICE CONVENIENT FOR QUICK SEARCH AND TAKING OUT

TECHNICAL FIELD

The disclosure relates to the technical field of card storage bags, and particularly to a storage bag device convenient for quick search and taking out.

BACKGROUND

At present, because cumbersome designs of storage bags, such as internal stacking with outer edge zipper seal, internal stacking with single direction pop-up, and wallet-type multi-layer or stepped storage, a user need to take a long time to take out cards or flip the cards to find a specific card back and forth after opening a card bag, and it is quite laborious and complicated and the product experience is poor. Using the above storage bags not only effects the mood of users, but also wastes users' more time to take and storage cards during daily queuing, which takes up more energy and time to take care of other items, carry-on luggage, and children.

SUMMARY

A main purpose of the disclosure is to provide a storage bag device convenient for quick search and taking out, which is reasonable in structure, more convenient to use, time-saving and multifunctional.

In order to achieve the purpose, the disclosure provides a storage bag device convenient for quick search and taking out, including a base, at least one card tray disposed on the base and a controlling card ejection assembly disposed on the base, the controlling card ejection assembly includes a rotating circlip member and a switch member. The rotating circlip member includes a circlip component, a protruding piece disposed on a bottom of the circlip component, a torsional spring disposed in the circlip component, and a cylinder disposed in the torsional spring; a bottom of the cylinder is connected to the base, and an end of at least one card tray is disposed in the circlip component. The switch member includes a slot, a step-like supporting seat, a spring, a button transmission rod and a switch resilient sheet; and the step-like supporting seat is disposed in the slot, the supporting seat includes a first supporting part and a second supporting part, the spring is disposed on the first supporting part, the button transmission rod is disposed in the spring, the switch resilient sheet is disposed on the second supporting part, the switch resilient sheet includes an extending part, which extends to an outside of the slot and corresponds to a position of the protruding piece.

In an embodiment, the rotating circlip member include a hollow circular truncated cone and at least one boss, the hollow circular truncated cone is disposed in the circlip component, the torsional spring is disposed in the hollow circular truncated cone, an outside of the hollow circular truncated cone is provided with the at least one boss, and an end of at least one card tray is disposed on the at least one boss through the circlip component.

In an embodiment, a shape of the switch resilient sheet is curved, the switch resilient sheet is divided into a first resilient sheet part and a second resilient sheet part, the first resilient sheet part is disposed on the second supporting part, and the second resilient sheet part is the extending part.

In an embodiment, the base is provided with five card trays, and the hollow circular truncated cone is provided with five bosses, positions of the five card trays correspond to positions of the five bosses, the five card trays are provided on the five bosses correspondingly through the circlip component.

In an embodiment, the button transmission rod is provided with a button.

In an embodiment, the switch member includes a resilient sheet and at least one cant hook, and one end of at least one cant hook is connected to at least one card tray, another end of the hook lever is connected to the resilient sheet, the resilient sheet is provided on a side of the switch resilient sheet.

In an embodiment, the switch member includes a spacing piece disposed on the resilient sheet.

In an embodiment, the storage bag device includes at least one card bag disposed on the at least one card tray.

In an embodiment, the storage bag device includes an upper cover, and the upper cover is disposed on the base.

In an embodiment, the storage bag device includes a non-slip pad disposed on an outside of the upper cover.

The beneficial effects of the disclosure are as follows: the storage bag device of the disclosure includes a base, the base is provided with at least one card tray and a controlling card ejection assembly, the controlling card ejection assembly includes a rotating circlip member and a switch member, the disclosure adopts the principal of one click to pop-up, a card medium and the corresponding card tray can pop-up in a fan-shape manner after button triggering, each card can show more area, so that it is convenient for users to find out cards they need with a glance, and take them out with another hand; the time for opening the zipper and searching for the direction of opening a single direction pop-up switch is omitted, and the time for users to repeatedly search for cards is omitted; the storage bag tightly attaching to the card tray adapts a three-layer design, which ensures that cards are not easy to slip out accidentally during storage, and avoids additional friction or other resistance between trays during storage, further reducing the product size and avoiding excessive product size due to the large fan-shaped unfolding radius.

The disclosure has strong practicality, more flexible use, diverse functions, simple use, safety, reliability, and is suitable for universal promotion and use.

BRIEF DESCRIPTION OF DRAWINGS

In order to illustrate embodiments of the disclosure or the technical solutions in the related art more clearly, a brief introduction will be made to the drawings needed in the embodiments below. Apparently, the drawings described below are only some embodiments of the disclosure. For those skilled in the art, other drawings can be obtained from these drawings without any creative effort.

Figure 1:
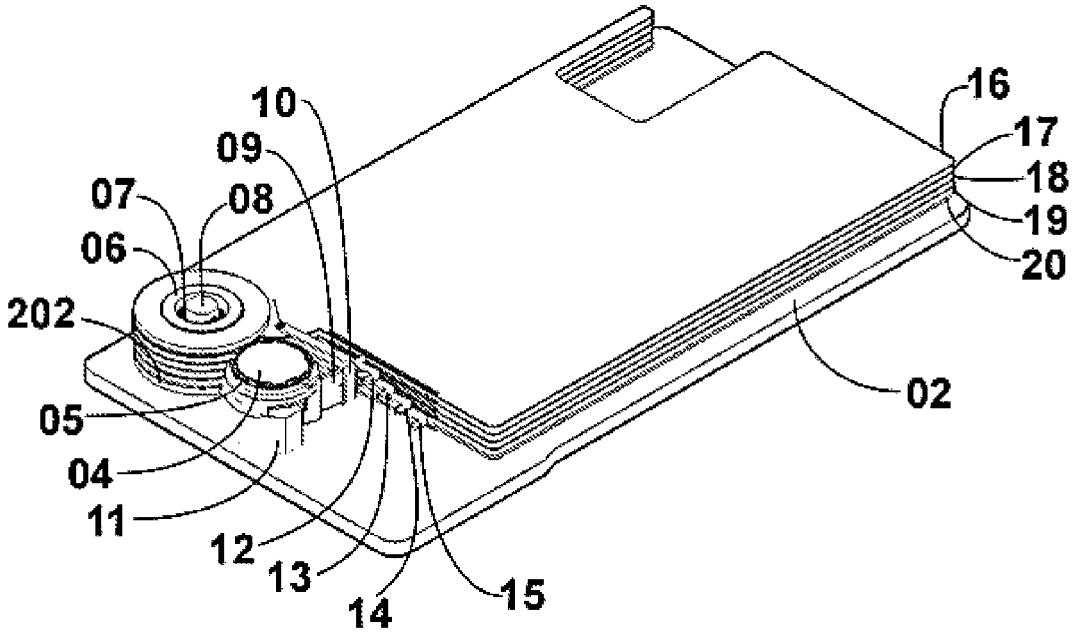
FIG. 1 is a first schematic structural diagram of a storage bag device convenient for quick search and taking out according to an embodiment of the disclosure.
Figure 2:
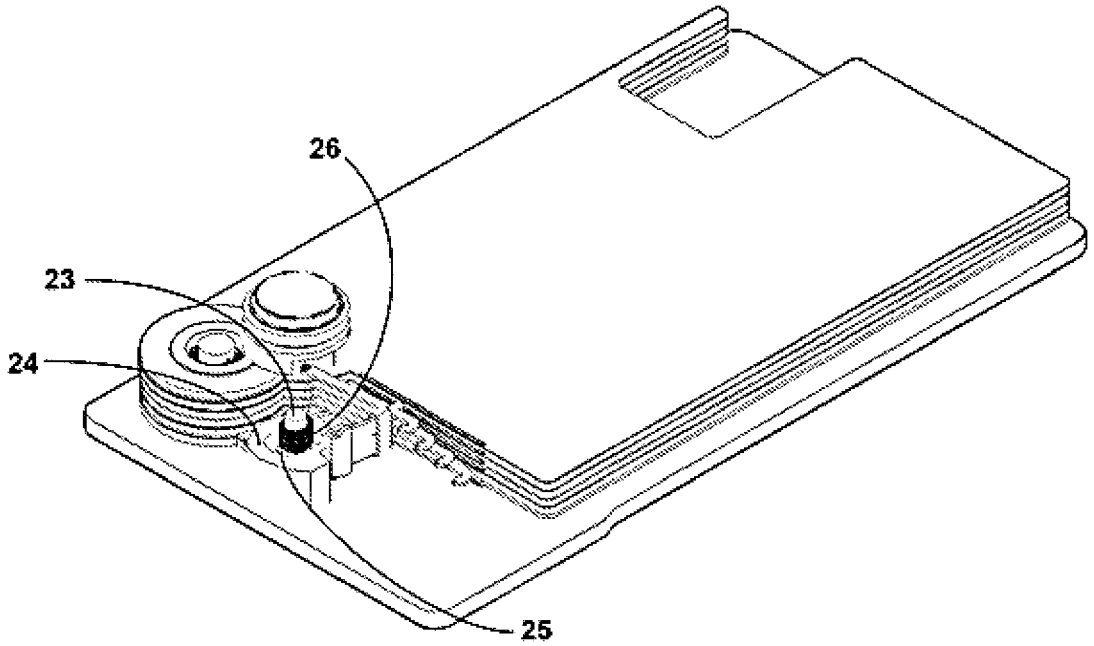
FIG. 2 is a second schematic structural diagram of a storage bag device convenient for quick search and taking out according to an embodiment of the disclosure.
Figure 3:
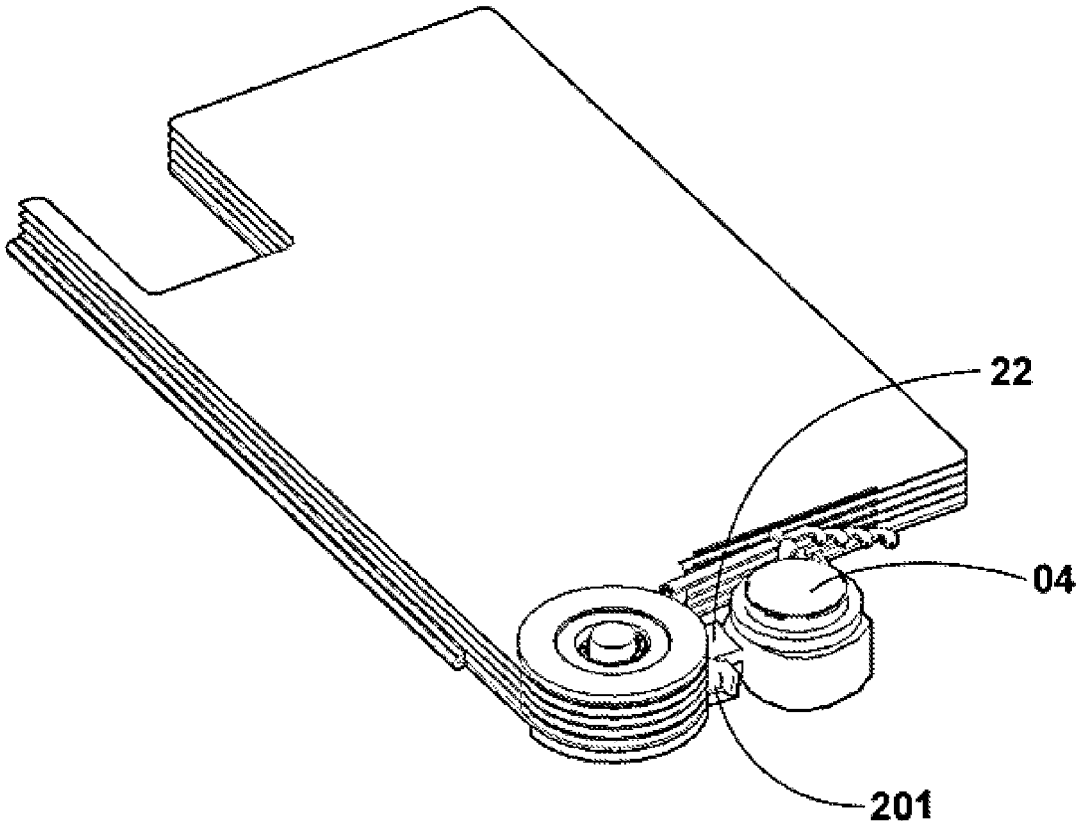
FIG. 3 is a third schematic structural diagram of a storage bag device convenient for quick search and taking out according to an embodiment of the disclosure.
Figure 4:
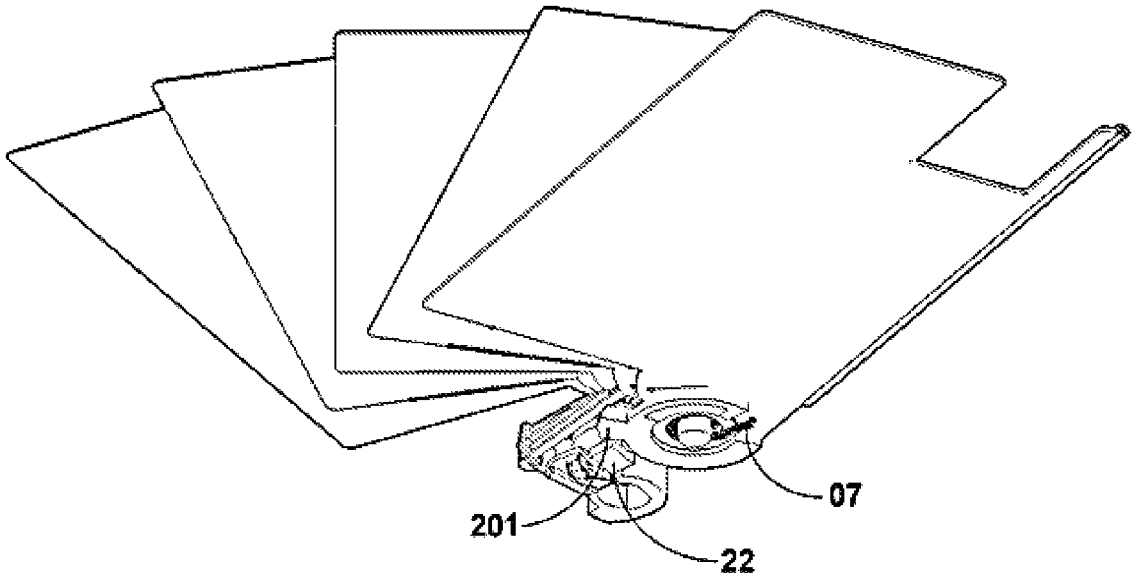
FIG. 4 is a schematic structural diagram of a storage bag device convenient for quick search and taking out in a unfold state according to an embodiment of the disclosure.
Figure 5:
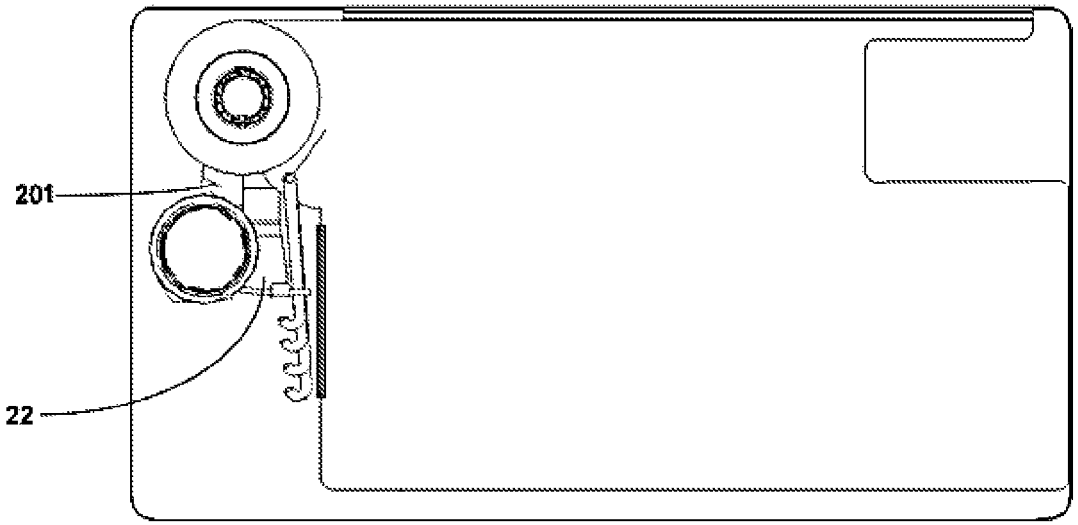
FIG. 5 is a top view of a storage bag device convenient for quick search and taking out according to an embodiment of the disclosure.
Figure 6:
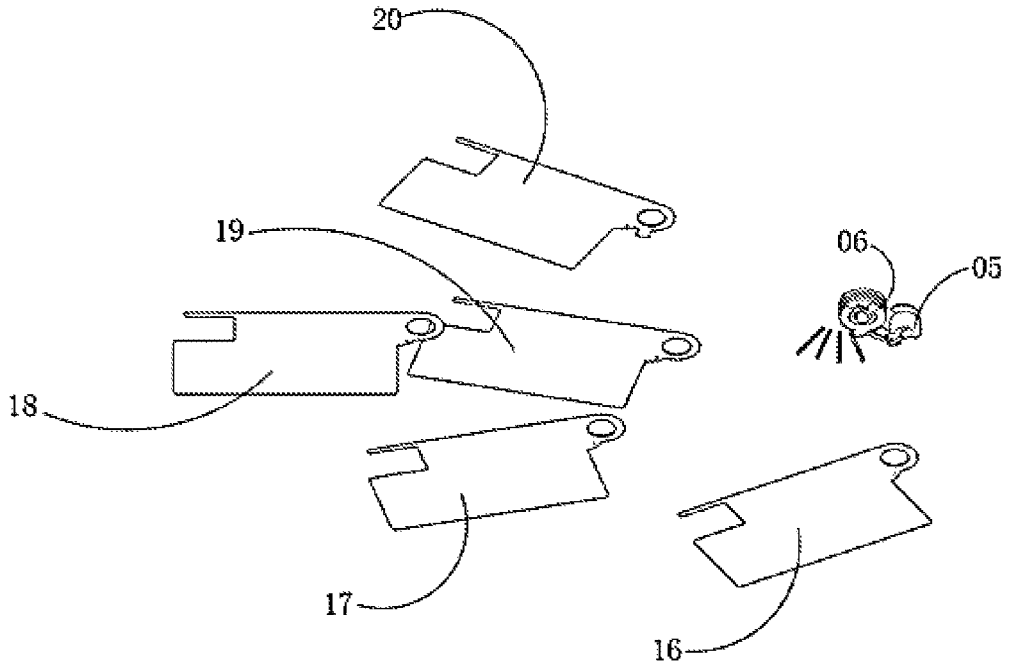
FIG. 6 is an exploded view of a storage bag device convenient for quick search and taking out according to an embodiment of the disclosure.
Figure 7:
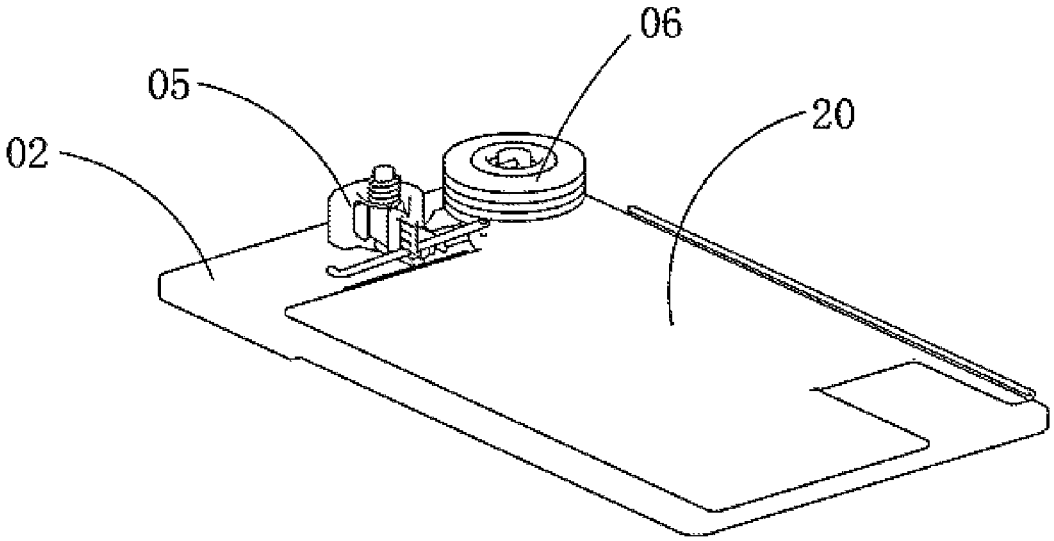
FIG. 7 is a fourth schematic structural diagram of a storage bag device convenient for quick search and taking out according to an embodiment of the disclosure.
Figure 8:
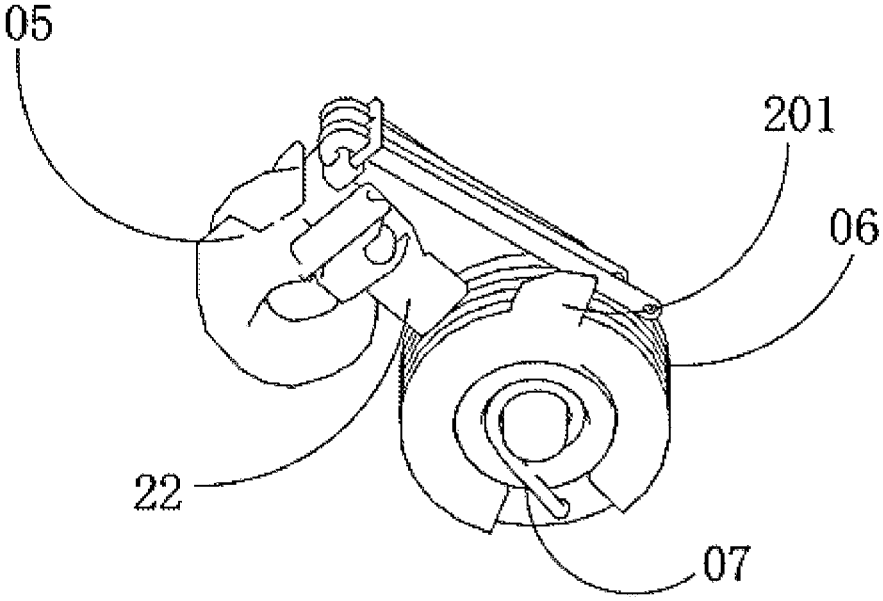
FIG. 8 is a schematic structural diagram of a controlling card ejection assembly of a storage bag device convenient for quick search and taking out according to an embodiment of the disclosure.

The implementation, functional features, and advantages of the disclosure will be further explained in conjunction with the embodiments, with reference to the accompanying drawings.

DETAILED DESCRIPTION OF EMBODIMENTS

The following will provide a clear and complete description of the technical solutions in the embodiments of the disclosure in combination with the attached drawings. Apparently, the described embodiments are only some of the embodiments of the disclosure, not all of them. Based on the embodiments in the disclosure, all other embodiments obtained by those ordinary skilled in the art without creative work should fall within the scope of protection of the disclosure.

It should be noted that all directional indications (such as up, down, left, right, front, rear . . . ) in the embodiments of the disclosure are only used to explain the relative position relationship, motion situation, etc. between components in a specific posture (as shown in the attached drawings). If the specific posture changes, the directional indications also change accordingly.

In the disclosure, unless otherwise clearly defined and limited, terms "connect", "fix", etc. should be understood broadly. For example, "fix" can be a fixed connection, a detachable connection, or a whole; it can be a mechanical connection or an electrical connection; it can be directly connected or indirectly connected through an intermediate medium, or it can be the internal connection between two components or the interaction relationship between two components, unless otherwise specified. For those ordinary skilled in the art, the specific meanings of the above terms in the disclosure can be understood based on specific situations.

In addition, if there are descriptions of "first", "second", etc. in the embodiments of the disclosure, the descriptions of "first", "second", etc. are only used for a purpose of description and cannot be understood as indicating or implying their relative importance or implying the number of indicated technical features. Therefore, features limited to "first" and "second" can explicitly or implicitly include at least one of these features. In addition, the meaning of "and/or" appearing in the disclosure should include three parallel schemes. Taking "A and/or B" as an example, it includes scheme A, or scheme B, or both schemes A and B. In addition, the technical solutions between various embodiments can be combined with each other, but must be based on the ability of those ordinary skilled in the art to achieve. When the combination of technical solutions conflicts or cannot be achieved, it should be considered that the combination of such technical solutions does not exist and is not within the scope of the protection of the disclosure. The disclosure provides a storage bag device convenient for quick search and taking out.

Embodiment 1

Referring to FIGS. 1 to 14, in an embodiment of the disclosure, a storage bag device convenient for quick search and taking out includes a base 02, the base 02 is provided with at least one card tray and a controlling card ejection assembly, the controlling card ejection assembly includes a rotating circlip member 06 and a switch member 05.

Referring to FIG. 1, in the embodiment, preferably, the base 02 is provided with a first card tray 16, a second card tray 17, a third card tray 18, a fourth card tray 19 and a fifth card tray 20.

Figure 10:
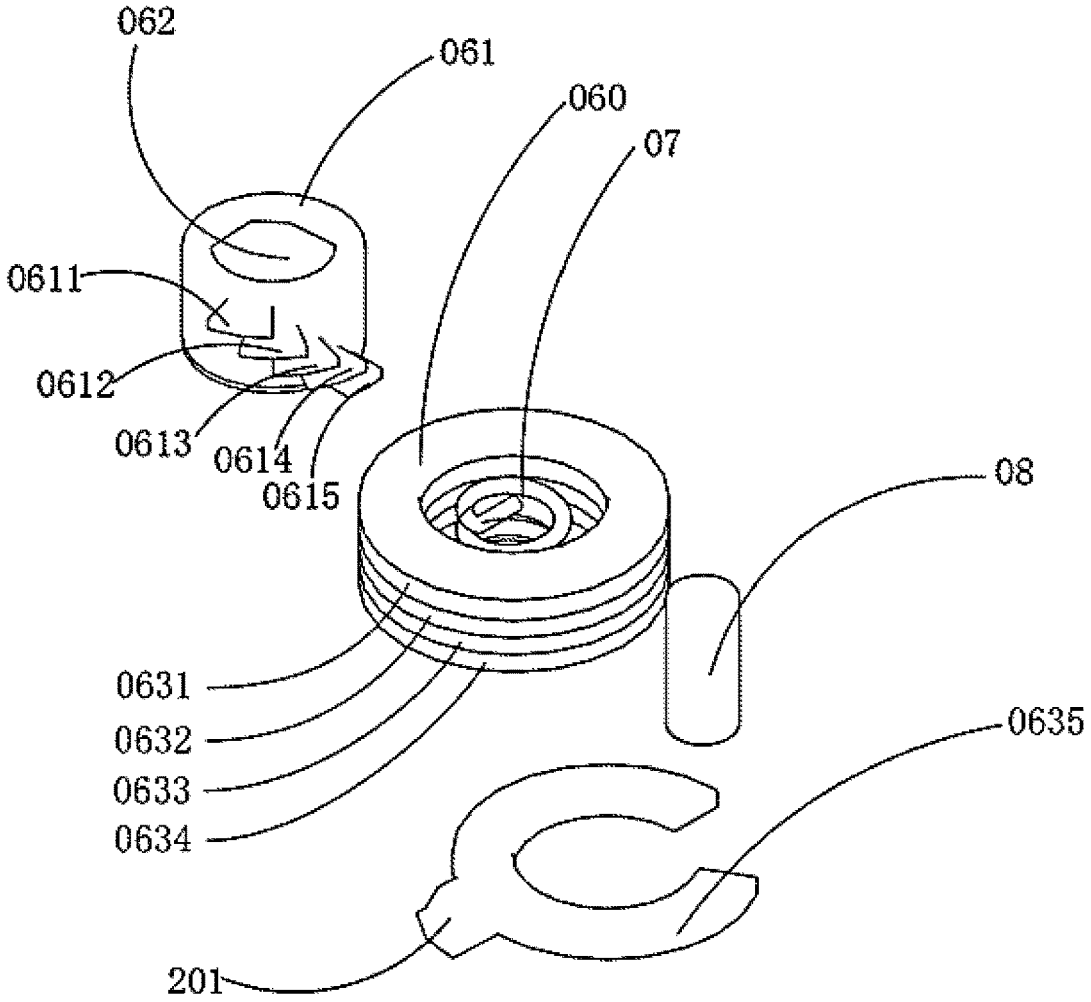
FIG. 10 is an exploded view of a rotating circlip member of a storage bag device convenient for quick search and taking out according to an embodiment of the disclosure.

Referring to FIG. 10, the rotating circlip member 06 includes a circlip component 060; preferably, the circlip component 060 includes five layer annular ring, an end of the first card tray 16 is disposed in the first layer annular ring, an end of the second card tray 17 is disposed in the second layer annular ring, an end of the third card tray 18 is disposed in the third layer annular ring, an end of the fourth card tray 19 is disposed in the fourth layer annular ring, an end of the fifth card tray 20 is disposed in the bottom layer annular ring.

Referring to FIG. 10, the bottom layer annular ring 0635 of the circlip component 060 is provided with a protruding piece 201; the bottom layer annular ring 0635 is disposed on the fifth card tray 20; the circlip component 060 is provided with a torsional spring 07, preferably, the torsional spring 07 is provided with a cylinder 08 therein, the bottom of the torsional spring 07 is disposed on the fifth card tray 20 of the bottom layer annular ring 0635 of the circlip component 060.

The torsional spring 07 is provided with the cylinder 08 therein, and a bottom of the cylinder is connected to the base 02.

Referring to FIGS. 11 to 14, the switch member 05 includes a slot 51. Preferably, the slot 51 is a semicircle with an opening 511 on a side wall of the slot 51. The slot 51 is provided in a step-like supporting seat 25, that is to say, the supporting seat 25 is curved shape.

The supporting seat 25 includes a first supporting part 252 and a second supporting part 253. Preferably, the second supporting part 253 is lower than the first supporting part 252, and the second supporting part 253 extends out the slot 51 through the opening 511; the first supporting part 252 is provided with a spring 26 thereon, and the spring 26 is provided with a button transmission rod 23 therein. Preferably, the button transmission rod 23 is provided with a button 04.

A switch resilient sheet 22 is disposed on the second supporting part 253, the switch resilient sheet 22 includes an extending part 2212, and the extending part extends to the outside of the slot 51 and corresponds to the position of the protruding piece 201.

Referring to FIGS. 1 to 14, in the embodiment, preferably, the circlip component 060 is provided with a hollow circular truncated cone 061 therein, the torsional spring 07 is disposed in the hollow circular truncated cone 061, and the outside of hollow circular truncated cone 061 is provided with at least one boss 062, preferably, the outside of the hollow circular truncated cone 061 is provided with a first boss 0611, a second boss 0612, a third boss 0613, a fourth boss 0614 and a fifth boss 0615, which correspond to the positions of the first card tray 16, the second card tray 17, the third card tray 18, the fourth card tray 19 and the fifth card tray 20 respectively.

The circlip component 060 has five layers, namely a first annular ring 0631, a second annular ring 0632, a third annular ring 0633, a fourth annular ring 0634, and a annular fifth ring 0635, which are fixed on the first card tray 16, the second card tray 17, the third card tray 18, the fourth card tray 19 and the fifth card tray 20 correspondingly.

The first annular ring 0631, the second annular ring 0632, the third annular ring 0633, the fourth annular ring 0634, and the fifth annular ring 0635 are correspondingly provided with the first holes, the first card tray 16, the second card tray 17, the third card tray 18, the fourth card tray 19 and the fifth card tray 20 are correspondingly provided with second holes; the centers of the first holes are on the same vertical line as the centers of the second holes on the first card tray 16, second card tray 17, third card tray 18, fourth card tray 19, and fifth card tray 20.

The hollow circular truncated cone 061 is disposed inside the rotating circlip member 06. The first boss 0611, the second boss 0612, the third boss 0613, the fourth boss 0614 and the fifth boss 0615 are snapped into a first groove 161, a second groove 171, a third groove 181, a fourth groove 191, and a fifth groove 200, respectively.

In an embodiment, preferably, the second resilient part 22 of the switch resilient sheet 22 is connected and fixed to the base 02.

Figure 9:
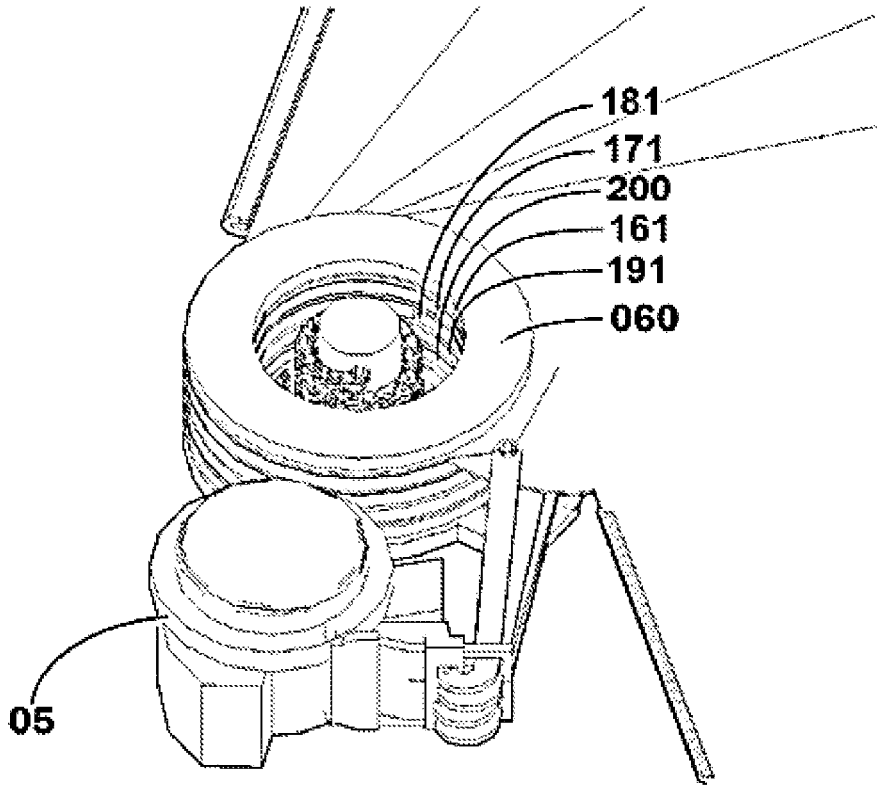
FIG. 9 is another schematic structural diagram of a controlling card ejection assembly of a storage bag device convenient for quick search and taking out according to an embodiment of the disclosure.

Referring to FIG. 9, in an embodiment, preferably, the inner side of the circlip component 060 defines the first groove 161, the second groove 171, the third groove 181, the fourth groove 191, and the fifth groove 200; the five grooves are located on the counterclockwise side, corresponding to the first boss 0611, the second boss 0612, the third boss 0613, the fourth boss 0614 and the fifth boss 0615.

To ensure that the opening process drives the first card tray 16, the second card tray 17, the third card tray 18 and the fourth card tray 19 to rotate out in sequence. The activity ranges of the first boss 0611, the second boss 0612, the third boss 0613, the fourth boss 0614 and the fifth boss 0615, in the horizontal direction inside the first groove 161, the second groove 171, the third groove 181, the fourth groove 191, and the fifth groove 200, namely, the sizes of the first groove 161, the second groove 171, the third groove 181, the fourth groove 191, and the fifth groove 200 increase sequentially according to the rotation angle, ensuring that there is a certain range of horizontal activity space in this position when searching for and retrieving cards, and the first card tray 16, the second card tray 17, the third card tray 18, and the fourth card tray 19 can be pushed and tightened sequentially in the process of pushing the fifth card tray 20 that has been unfolded to the outermost side back to the lower cover 02 with the user's hand. And after the fifth card tray is locked, the first card tray 16, the second card tray 17, the third card tray 18, and the fourth card tray 19 will be correspondingly locked by the rotated first boss 0611, the second boss 0612, the third boss 0613, the fourth boss 0614.

In an embodiment, preferably, the shape of the switch resilient sheet 22 is curved. The switch resilient sheet 22 is divided into the first resilient sheet part 2211 and the second resilient sheet part 2212; the first resilient sheet part 2211 is connected to the second supporting part 253, and the second resilient sheet part 2212 is an extending part.

Referring to FIGS. 1 to 14, in an embodiment, the bottom of the torsional spring 07 is disposed on the bottom layer annular ring (i.e., the fifth annular ring 0635) of the circlip component 060, and the fifth annular ring 0635 of the circlip component 060 is disposed on the fifth card tray 20, the fifth card tray 20 can rotate with the rotation of the fifth annular ring 0635.

When the user is using the device, the button 04 is pressed, the button transmission rod 23 moves down so that the first supporting part 252 of the supporting seat 25 pries the second supporting part 253, which makes the extending part 2212 of the switch resilient sheet 22 tilt up, and when the extending part 2212 is titled up and abutted against the protruding piece 201 of the fifth annular ring 0635 of the circlip component 060, the extending part 2212 releases the protruding piece 201, so that the torsional spring 07 together with the card tray 20 rotates out centered on the cylinder 08.

Meanwhile, the circlip component 060 drives the fifth boss 0615 on the circular truncated cone 061, causing the fifth card tray 20 to rotate; similarly, by releasing the protruding piece 201, the extending part 2212 make the hollow circular truncated cone 061 drive the circlip component 060 to rotate each layer annular ring in sequence, thereby driving the first card tray 16, the second card tray 17, the third card tray 18, and the fourth card tray 19 to rotate out correspondingly.

Figure 11:
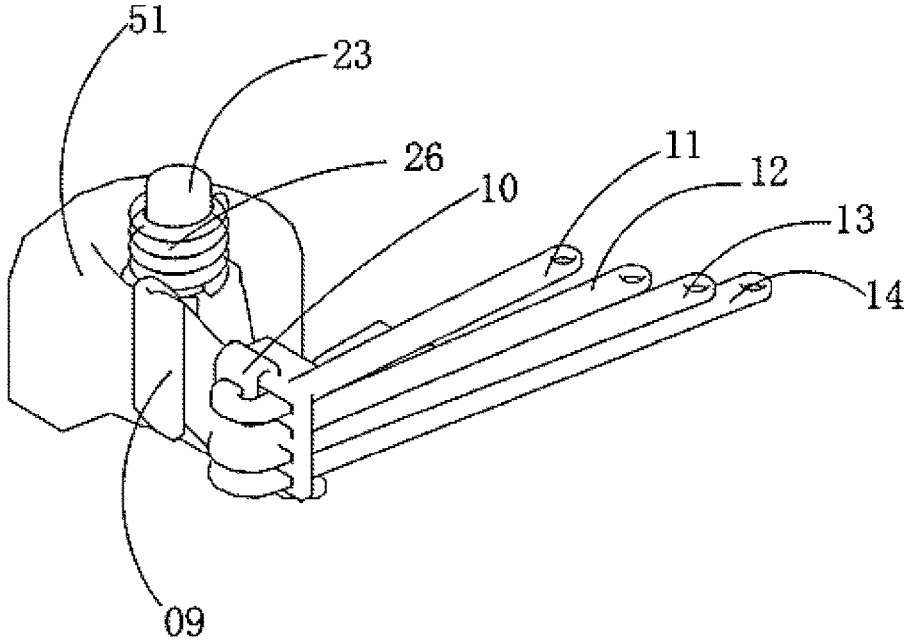
FIG. 11 is a schematic structural diagram of a switch member of a storage bag device convenient for quick search and taking out according to an embodiment of the disclosure.
Figure 12:
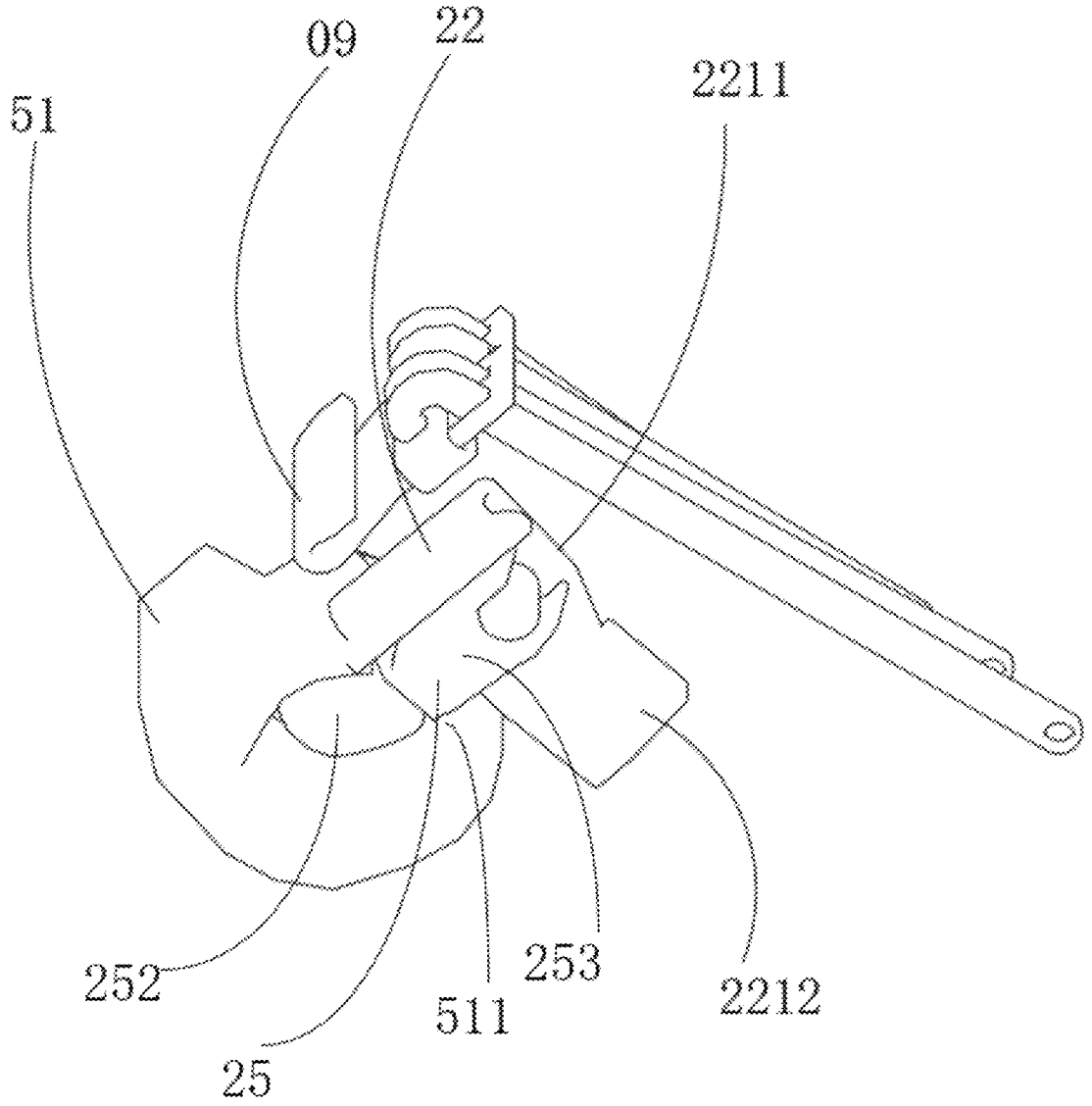
FIG. 12 is another schematic structural diagram of a switch member of a storage bag device convenient for quick search and taking out according to an embodiment of the disclosure.
Figure 13:
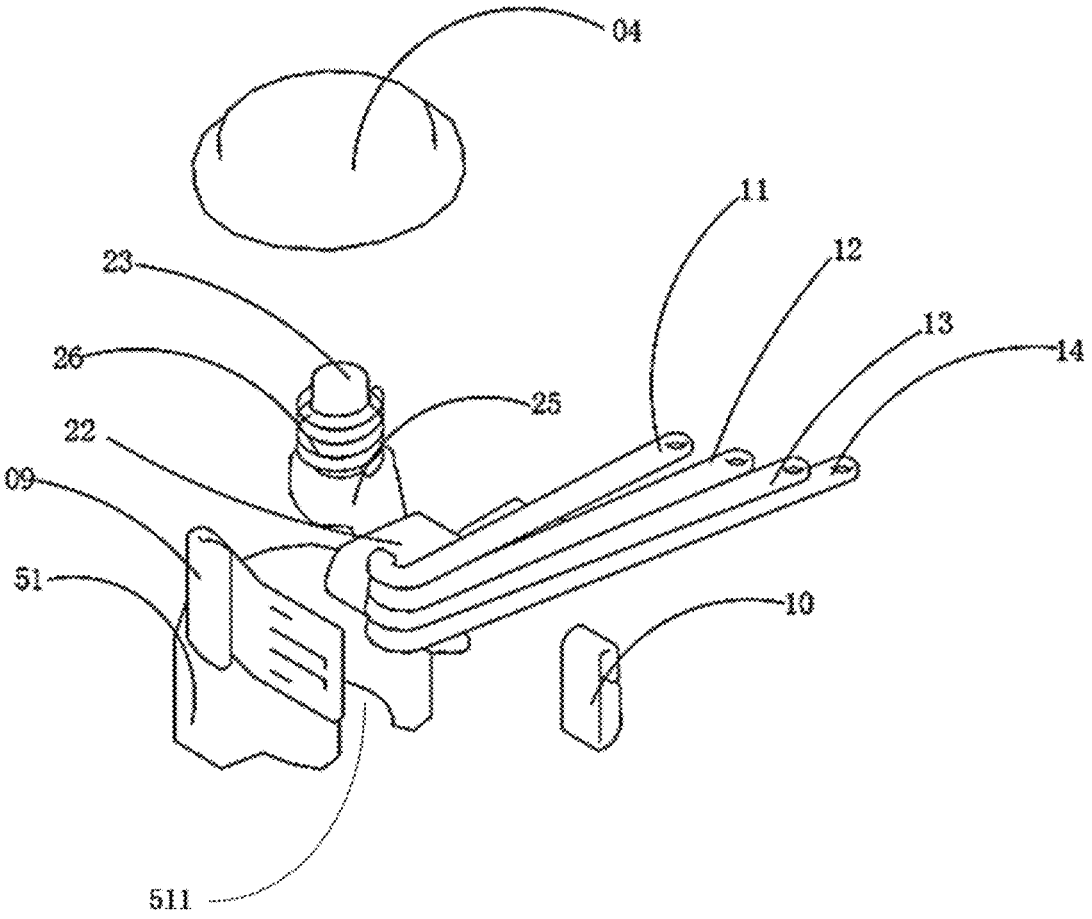
FIG. 13 is an exploded view of a switch member of a storage bag device convenient for quick search and taking out according to an embodiment of the disclosure.
Figure 14:
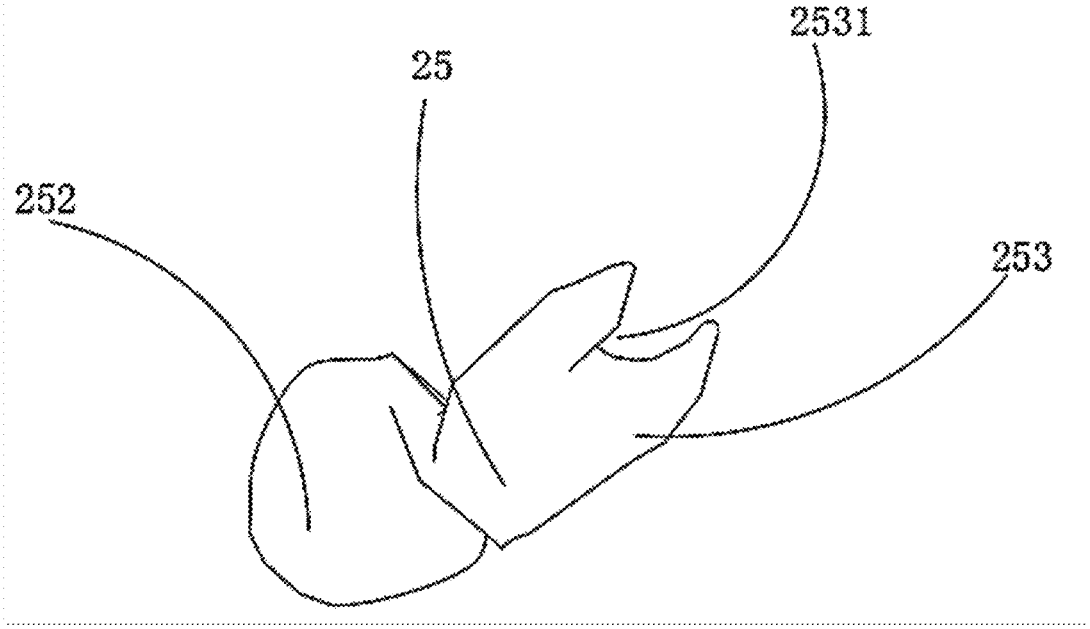
FIG. 14 is a schematic structural diagram of a supporting seat of a switch member of a storage bag device convenient for quick search and taking out according to an embodiment of the disclosure.

Referring to FIGS. 11, 12 and 13, in the embodiment, preferably, the switch member 05 includes a resilient sheet 09 and at least one hook lever. Preferably, the hook lever includes a first hook lever 11, a second hook lever 12, a third hook lever 13 and a fourth hook lever 14. The first hook lever 11, the second hook lever 12, the third hook lever 13 and the fourth hook lever 14 are connected to the first card tray 16, the second card tray 17, the third card tray 18, and the fourth card tray 19, correspondingly, the four hook levers can rotate horizontally relative to the four card trays; and other ends of the first hook lever 11, the second hook lever 12, the third hook lever 13 and the fourth hook lever 14 are respectively snapped into the gaps of the resilient sheet 09 from top to bottom. Preferably, the resilient sheet 09 includes a spacing piece 10. Furthermore, preferably, the resilient sheet 09 is disposed on a side of the switch resilient sheet 22.

Embodiment 2

Figure 15:
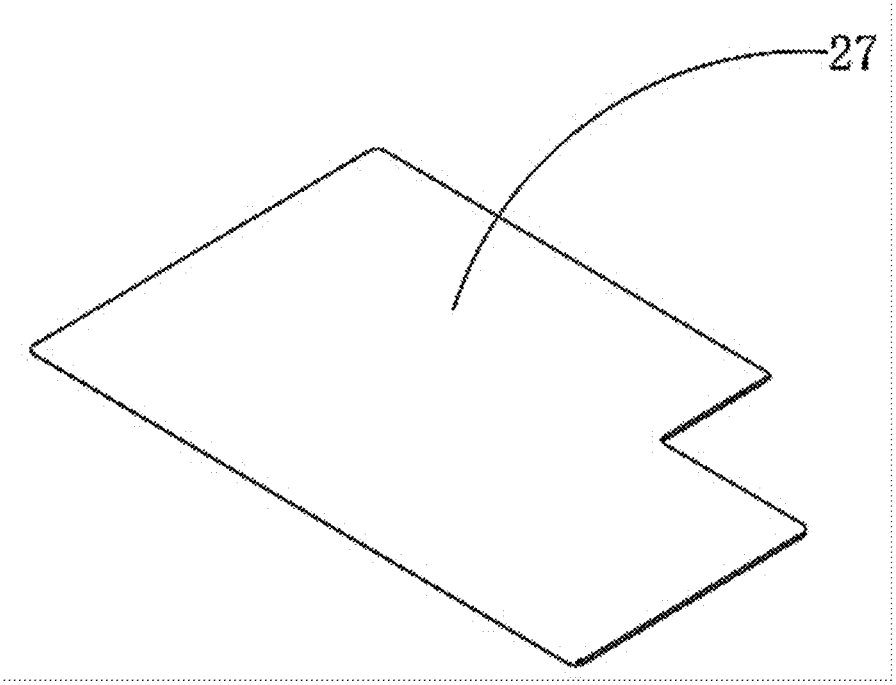
FIG. 15 is a schematic structural diagram of a card bag of a storage bag device convenient for quick search and taking out according to an embodiment of the disclosure.
Figure 16:
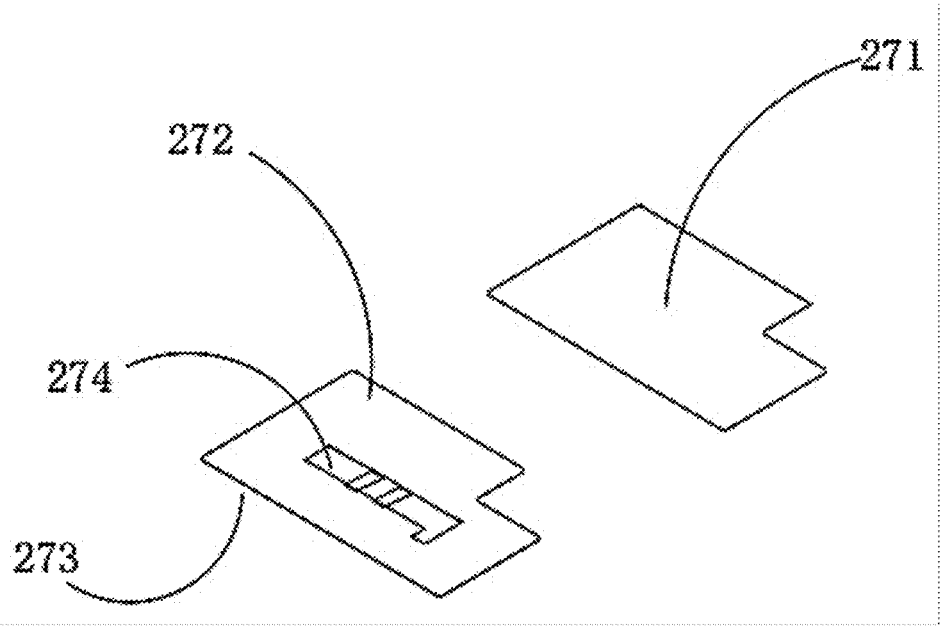
FIG. 16 is an exploded view of a card bag of a storage bag device convenient for quick search and taking out according to an embodiment of the disclosure.

Referring to FIGS. 15 and 16, in the embodiment, preferably, the card tray is provided with a card bag 27.

The card bag 27 includes a first layer 271, a second layer 272, and a third layer 273. The second layer 272 includes a suture part 274, which is slightly longer than the length of the card bag to provide internal extrusion pressure. The first layer 271 and the second layer 272 are sutured on the upper, lower, and left sides, while the second layer 272 and the third layer 273 are sutured on all sides. The left part of the suture part 274 is sutured on the left side of the second layer 272 and the third layer 273. The middle part of the suture part 274 passes through a hole and exists between the first layer 271 and the second layer 272. The right part of the suture part 274 is sutured between the second layer 272 and the third layer 27.

Figure 17:
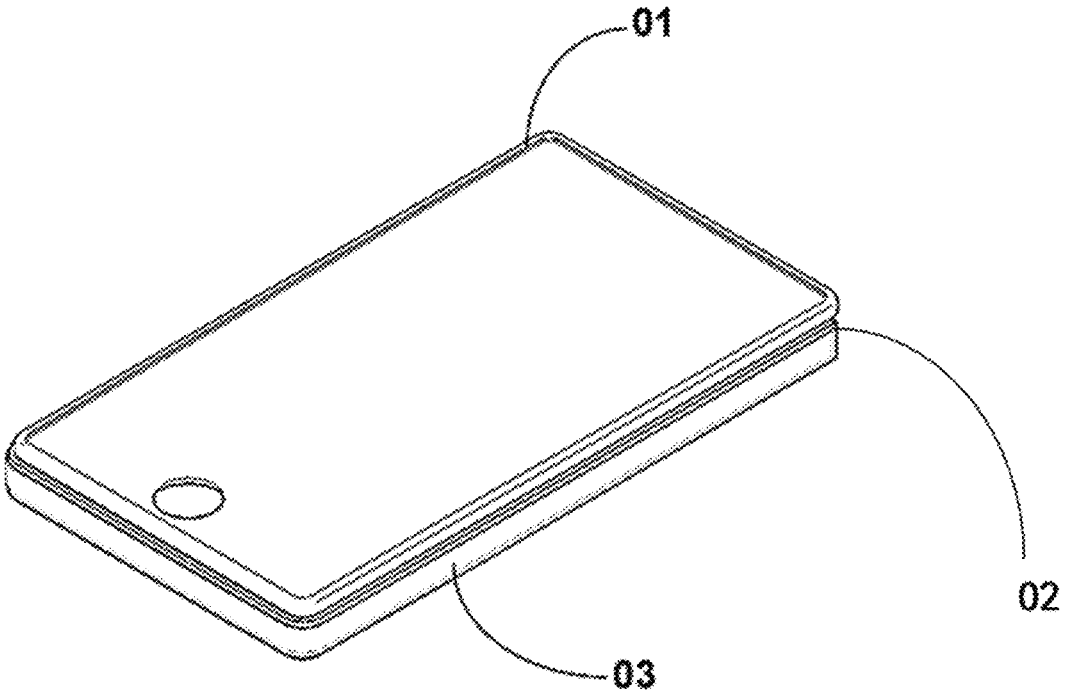
FIG. 17 is a fifth schematic structural diagram of a storage bag device convenient for quick search and taking out according to an embodiment of the disclosure.

Referring to FIG. 17, in the embodiment, preferably, the base 02 is provided with an upper cover 01 thereon, and the upper cover 01 is disposed on the base 02.

In the embodiment, furthermore, preferably, there is a non-slip pad 03 outside of the upper cover 01.

In the embodiment, the cylinder 08 is connected to the upper cover 01 and the base 02; the non-slip pad 03 is tightly attached to the left and lower sides of the upper cover 01; the first card tray 16, the second card tray 17, the third card tray 18, the fourth card tray 19, and the fifth card tray 20 are stacked in the middle of the upper cover 01 and the lower cover 02 through holes in the upper left corners, and can rotate horizontally. Each card tray is fixed with a card bag 27.

The first hook lever 11, the second hook lever 12, the third hook lever 13 and the fourth hook lever 14, the fifth hook lever 15 correspondingly across the gaps of the resilient sheet 09, ends of the first hook lever 11, the second hook lever 12, the third hook lever 13 and the fourth hook lever 14 and the fifth hook lever 15 are fixed by corresponding holes on the first card tray 16, the second card tray 17, the third card tray 18, the fourth card tray 19, and the fifth card tray 20, correspondingly. The first hook lever 11, the second hook lever 12, the third hook lever 13 and the fourth hook lever 14, the fifth hook lever 15 can correspondingly rotate horizontally around the corresponding single point fixed position.

The resilient sheet 09 is fixed with the upper cover 01 or the base 02. The spacing piece 10 restricts the gaps of the resilient sheet 09, correspondingly limiting the movement range of the second hook lever 12, the third hook lever 13 and the fourth hook lever 14, the fifth hook lever 15, thereby limiting the rotation angle and expansion range of the first card tray 16, the second card tray 17, the third card tray 18, and the fourth card tray 19.

When users search for or retrieve cards, due to the resilientity of the resilient sheet 09, there is a certain amount of space to manually adjust the horizontal expansion range again. When the user needs to close the card bag, the card is put back into the card bag 27; When inserting the card on the right side, the card will be pressed by the suture part 274, so that the card will not fall due to the unobstructed or small blocking range on the right side of the upper cover 01 and the base 02, and will not affect the smoothness of sliding between each tray and card bag.

During the process of pushing the fifth card tray 20, which extends to the outermost side, back between the upper cover 01 and the base 02, the user's hand will be in contact with the fourth card tray 19, the third card tray 18, the second card tray 17, and the first card tray 16. At the same time, the rotating circlip member will rotate accordingly. Meanwhile, the first boss 0611, the second boss 0612, the third boss 0613, the fourth boss 0614 on the circular truncated cone will also rotate accordingly, the groove or hole 191, groove or hole 181, groove or hole 171, and groove or hole 161 drive the fourth card tray 19, the third card tray 18, the second card tray 17, and the first card tray 16 to tighten. With the rotation of the fifth card tray 20, pushing open the gap between titled part of the extending part 2212 of the switch resilient sheet 22 and the base 02 until it passes between the switch resilient sheet 22 and the base 02, the slightly thicker side of the protruding piece 201 is locked with the first resilient sheet part 2511 of the switch resilient sheet 22, which is not titled, the fourth card tray 19, the third card tray 18, the second card tray 17, and the first card tray 16 will also be locked by the first boss 0611, the second boss 0612, the third boss 0613, and the fourth boss 0614, correspondingly, to the fourth groove 191, the third groove 181, the second groove or hole 171, and the first groove 161, thereby locking all card trays tightly. Reserving a small amount of space on the lower side of the card package to facilitate the complete locking of the protruding piece 201 through the switch resilient sheet 22, thereby to complete the process of closing the card package.

In the disclosure, the rotation center point of the card tray can be located at or near one of the four corners of the card package, as well as on or near one of the four edges of the card bag; any changes in the position of other components in the disclosure are all protected by the disclosure. The torque force generated by the rotation and ejection of the card tray can be provided by a vertical spring or a circular spring to provide linear or arc-shaped expansion thrust, or can be replaced by the pulling force on the outer surface of the rotating part; The card tray can be individually locked by the tips of each card tray.

The hook lever used to provide reverse force in the card bag of the disclosure can be replaced by other shapes and other corresponding shapes or methods that can provide obstruction; The hook lever inside the card bag can be replaced by other methods that provide evenly unfolding card images, such as using a constrained connection between the horizontal range of card trays, or using spring needles to clamp the grooves reserved for the upper and lower covers to achieve fixed or constrained expansion of the card trays within a certain range. The rotation angle range of the card tray is: greater than 0° but less than 360 °.

There can be a small resilient sheet on the right side of the upper cover 01 and base 02 of the card bag to prevent the card from accidentally falling out. The upper cover 01 and the base 02 can be integrated or partially integrated. The angle range for controlling the ejection of the card tray can be limited by other additional sliding needles, spring needles, and blocking structures between the upper and lower covers inside the card bag.

There is no limit to the number and capacity of card trays. The specific shape of card bag 27 is not limited, and the direction of the card outlet is not limited. The lower side of the card bag outlet can also be cancelled or partially cancelled; The card tray is made of soft and resilient materials, and the upper and lower covers corresponding to the card placement can also be made of soft and resilient materials. The rotating circlip member 06 can be independent of each layer and achieve transmission during unfolding through the concave and convex snapping of each layer; and the rotating circlip member 06 can be cancelled, the first card tray 16, the second card tray 17, the third card tray 18, the fourth card tray 19, and the fifth card tray 20 are mutually locked around the arc track of the cylinder 08, so as to realize the transmission during unfolding and control of the unfolding range.

The numbers and layers of card trays described in the disclosure are unlimited. The outer side of the card bag can be equipped with clips or straps for holding paper currency. The button 04 can also be set below the card bag to directly push the switch resilient sheet 22 to achieve the purpose of ejecting the card tray.

The above are only some embodiments of the disclosure and do not limit the scope of the protection of the disclosure. Any equivalent structural changes made by using the description and attached drawings of the disclosure, or direct/indirect applications in other related technical fields should be included in the scope of protection of the disclosure.

What is claimed is:

1. A storage bag device, comprising:

a base, at least one card tray disposed on the base, and a controlling card ejection assembly disposed on the base; wherein the controlling card ejection assembly comprises a rotating circlip member and a switch member;

wherein the rotating circlip member comprises:

a circlip component, a protruding piece disposed on a bottom of the circlip component, a torsional spring disposed in the circlip component, wherein a bottom end of the torsional spring is disposed on the at least one card tray, and a cylinder disposed in the torsional spring; wherein a bottom of the cylinder is connected to the base, and an end of the at least one card tray is disposed in the circlip component;

wherein the switch member comprises:

a slot, wherein the slot is semicircular with an opening on a side wall of the slot, a step-like supporting seat disposed in the slot, wherein the step-like supporting seat comprises a first supporting part and a second supporting part connected to the first supporting part, the second supporting part is lower than the first supporting part, and the second supporting part extends out the slot through the opening, a spring, disposed on the first supporting part, a button transmission rod, disposed in the spring and disposed on the first supporting part, a button, disposed on the button transmission rod, and a switch resilient sheet disposed on the second supporting part, wherein the switch resilient sheet comprises an extending part, and the extending part is disposed outside the slot and corresponds to a position of the protruding piece.

2. The storage bag device as claimed in claim 1, wherein the rotating circlip member comprises:

a hollow circular truncated cone disposed in the circlip component, wherein the torsional spring is disposed in the hollow circular truncated cone, and at least one boss disposed on an outside of the hollow circular truncated cone; wherein an end of the at least one card tray is disposed on the at least one boss through the circlip component.

3. The storage bag device as claimed in claim 2, wherein a shape of the switch resilient sheet is curved, the switch resilient sheet is divided into a first resilient sheet part and a second resilient sheet part, the first resilient sheet part is disposed on the second supporting part and the second resilient sheet part is the extending part.

4. The storage bag device as claimed in claim 3, wherein the at least one card tray comprises five card trays, the at least one boss comprises five bosses, positions of the five card trays correspond to positions of the five bosses respectively; the five card trays are disposed on the five bosses correspondingly through the circlip component.

5. The storage bag device as claimed in claim 1, wherein the storage bag device is operable in two different states, in a first state of the two different states, the extending part abuts against the protruding pieces; in a second state of the two different states, the button transmission rod is configured to: when the button is pressed down, move down, to thereby make the first supporting part pry the second supporting part, and make the extending part tilt up and thereby make the protruding piece be released, to make the torsional spring drive the at least one card tray to rotate out.

6. The storage bag device as claimed in claim 1, wherein the switch member comprises a resilient sheet and at least one hook lever, one end of the at least one hook lever is connected to the at least one card tray, another end of the hook lever is connected to the resilient sheet, the resilient sheet is disposed on a side of the switch resilient sheet.

7. The storage bag device as claimed in claim 6, wherein the switch member comprises a spacing piece disposed on the resilient sheet.

8. The storage bag device as claimed in claim 1, wherein the storage bag device comprises at least one card bag disposed on the at least one card tray.

9. The storage bag device as claimed in claim 1, wherein the storage bag device comprises an upper cover buckled disposed on the base.

10. The storage bag device as claimed in claim 9, wherein the storage bag device comprises a non-slip pad disposed on an outside of the upper cover.

11. A storage bag device, comprising:

a base;

at least one card tray, disposed on the base;

a rotating circlip member, disposed on the base and comprising:

a circlip component;

a hollow circular truncated cone, disposed in the circlip component;

at least one boss, disposed on an outside of the hollow circular truncated cone, wherein an end of the at least one card tray is disposed on the at least one boss through the circlip component;

a protruding piece, disposed on a bottom of the circlip component;

a torsional spring, disposed in the hollow circular truncated cone, wherein a bottom end of the torsional spring is fixed on the at least one card tray; and a cylinder, disposed in the torsional spring, wherein a bottom of the cylinder is connected to the base; and a switch member, disposed on the base and comprising:

a slot, wherein the slot is semicircular with an opening on a side wall of the slot;

a step-like supporting seat, comprising a first supporting part and a second supporting part connected to the first supporting part, the second supporting part is lower than the first supporting part, the first supporting part is disposed in the slot, and the second supporting part extends out the slot through the opening;

a spring, disposed on the first supporting part;

a button transmission rod, disposed in the spring and disposed on the first supporting part;

a button, disposed on the bottom transmission rod; and a switch resilient sheet disposed on the second supporting part, wherein the switch resilient sheet comprises an extending part, and the extending part is disposed outside the slot and abuts against a side of the protruding piece;

wherein the button transmission rod is configured to: when the button is pressed down, move down, to thereby make the first supporting part pry the second supporting part, and make the extending part tilt up and thereby make the protruding piece be released, to make the torsional spring drive the circlip component to rotate and thereby drive the at least one boss to cause the at least one card tray to rotate.

* * * * *